United States Patent [19]

Muramatsu

[11] 4,231,310

[45] Nov. 4, 1980

[54] REMOTE CONTROL UNIT

[75] Inventor: Shigeru Muramatsu, Hamamatsu, Japan

[73] Assignee: Nippon Gakki Seizo Kabushiki Kaisha, Japan

[21] Appl. No.: 895,109

[22] Filed: Apr. 10, 1978

[30] Foreign Application Priority Data

Apr. 20, 1977 [JP] Japan ..... 52-48973[U]

[51] Int. Cl.[3] ..... B63H 25/00

[52] U.S. Cl. ..... 114/144 RE; 200/157

[58] Field of Search ..... 114/144 RE; 115/18 R, 115/18 E, 6.1; 180/79.1; 318/160, 295, 17, 19, 591, 518; 338/78, 135, 167; 46/253; 200/47, 157

[56] References Cited

U.S. PATENT DOCUMENTS

| | | | |
|---|---|---|---|
| 2,519,726 | 8/1950 | Wollard | 200/157 |
| 2,891,205 | 6/1959 | Freeman | 114/144 RE |
| 3,402,505 | 9/1968 | Nakamura | 46/253 |
| 3,431,475 | 3/1969 | Wesner | 318/588 |
| 3,465,841 | 9/1969 | Pulskamp et al. | 338/78 |
| 4,085,301 | 4/1978 | Smith | 200/157 X |
| 4,120,258 | 10/1978 | Spurgin | 114/144 E |

*Primary Examiner*—Trygve M. Blix
*Assistant Examiner*—Jesús D. Sotelo
*Attorney, Agent, or Firm*—Ostrolenk, Faber, Gerb & Soffen

[57] ABSTRACT

In the construction of a remote control unit advantageously usable for an automatic steering system of small-sized boats and cruisers, a rotatable main-dial, which is adapted for adjusting the resistance of a main variable resistor for manual steering, is always elastically registered at the zero-point for automatic zero-point resetting purpose. In addition to the automatic zero-point resetting function without requirement for any highly skilled technique, unexpected and dangerous accidental turning of the main-dial can be successfully obviated.

1 Claim, 4 Drawing Figures

REMOTE CONTROL UNIT

BACKGROUND OF THE INVENTION

The present invention relates to an improved remote control unit, and more particularly relates to improvement in the zero-point resetting function of a remote control unit advantageously usable for automatic steering system of small-sized boats and cruisers.

In general, a remote control unit is provided with a variable resistor whose resistance is freely adjustable by manually turning a dial mechanically coupled to the variable resistor. In use, the remote control unit is operationally coupled to a rudder mechanism via a main control unit. Change in the resistance of the above-described variable resistor causes corresponding change in the electric signal, e.g. voltage signal, to be passed to the main control unit from the remote control unit in order to activate the rudder mechanism.

The conventional remote control unit of the above-described type is a simple combination of a manually operable dial with a potentiometer and is provided with the no automatic zero-point resetting function. Therefore, when the dial is turned over a prescribed angle and, as a result, the boat starts to change the sailing course to the selected one, the dial needs to be gradually and carefully returned to the zero-point in accordance with development of the change in the sailing course. This manual resetting operation required highly skilled technique based upon long experience in practice. In addition, such gradual zero-point resetting adjustment is quite troublesome and inconvenient for the operator who is busy with various work necessary for safe navigation of the boat. Further, when any shock is applied to the remote control unit and the dial is made to turn unexpectedly, the rudder is turned over an angle corresponding to the unexpected turning angle of the dial and kept at the turned angular position until the operator finds the unexpected turning of the dial and resets the dial to the zero-point. This naturally causes corresponding unexpected change in the sailing course of the boat which is seriously dangerous when the boat sails, for example, through a narrow strait.

SUMMARY OF THE INVENTION

It is an object of the present invention to provide a compact and light remote control unit easily operable by simple finger action.

It is another object of the present invention to provide a remote control unit which can be reset to the zero-point by simply detaching the user's finger from the dial for adjusting the variable resistor without requiring any highly skilled technique.

It is the other object of the present invention to provide a remote control unit in which the dial for adjusting the variable resistor never rotates accidentally even when a shock is accidentally applied to the unit.

It is a further object of the present invention to provide a remote control unit advantageously usable for the automatic steering system of a small-sized boat or cruiser which has an enhanced operational reliability in quickly responding to the sailing mode of the boat.

In accordance with the basic aspect of the present invention, an A-M switch for shifting the steering mode from automatic to manual and vice versa is contained within a cylindrical main casing, a main-dial operationally coupled within the main casing to a main variable resistor for manual steering is axially turnably mounted to one end of the main casing, the main-dial is always elastically registered at the zero-point while being allowed to turn over prescribed angular ambit on both sides of the zero-point and a sub-dial operationally coupled within the main casing to a subordinate variable trimming resistor is axially rotatably mounted to the other end of the main casing.

Although the following description is focussed upon application of the present invention to the automatic steering system of small-sized boats and cruisers, a wide variety of applications is employable with minor modifications popular to the skilled in the art.

DESCRIPTION OF THE PREFERRED EMBODIMENT

Figure 1:
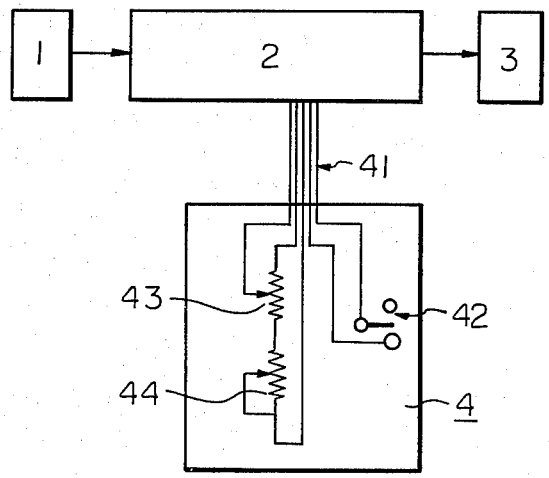
FIG. 1 is a block diagram of an example of the automatic steering system to which the present invention is advantageously applied.

The construction of one example of an automatic steering system in which the remote control unit of the present invention may be used is roughly illustrated in FIG. 1. As shown therein, the automatic steering system comprises a sensor circuit 1, a main control unit 2 which receives signals from the sensor circuit 1, a rudder mechanism 3 operationally coupled to the main control unit 2 and a remote control unit 4 coupled to the main control unit 2 via suitable wires 41.

The sensor circuit 1 senses variations in factors which influence the navigation of the boat such as navigation course, wind heading and tideway, and inputs deviation signals representative of these variations to the main control unit 2.

The remote control unit 4, which is used as a remote steering unit in the present application, includes an A-M switch 42 for shifting the steering mode from automatic to manual and vice versa. The remote control unit 4 further includes a main variable resistor 43 for manual steering and a subordinate variable resistor 44 for trimming which are coupled in series to each other.

The resistance of the main variable resistor 43 is adjusted by manually turning a main-dial (not shown in FIG. 1 but described below) provided on the remote control unit 4. In accordance with the change in the resistance of the main variable resistor 43, the electric signal, e.g. a voltage signal, to be passed to the main control unit 2 from the remote control unit 4 changes in order to drive the rudder mechanism 3, accordingly with the result that the rudder is turned and sailing course of the boat is changed.

The resistance of the subordinate variable resistor 44 is adjusted by manually turning a sub-dial (not shown in FIG. 1 but described below) provided on the remote control unit 4. Subordinate variable resistor 44 is provided for fine compensation of the main variable resistor 43. As described above, remote steering is effected by manually turning the maindial to either side of a predetermined zero-point. When the main-dial is registered at the zero-point, the rudder is placed on the neutral axis. In practice, however, the sailing course of the boat is greatly influenced by tideway and wind and the boat does not sail straight on the selected course even when the main-dial is registered at the zero-point and the rudder is on the neutral axis. In addition, every rudder mechanism 3 has its own operational habit and, due to this operational habit, the boat does not always sail straight on the selected course even when the rudder is registered at the neutral axis.

For these reasons, the boat does not always sail straight on the selected course even when the main dial is registered at the zero-point. In order to obviate this problem, the subordinate variable resistor 44 is coupled in series to the main variable resistor 43 and resistance of the subordinate variable resistor 44 is adjusted by turning the subdial so that the boat sails straight on the selected course when the main-dial is registered at the zero-point.

Figure 2:
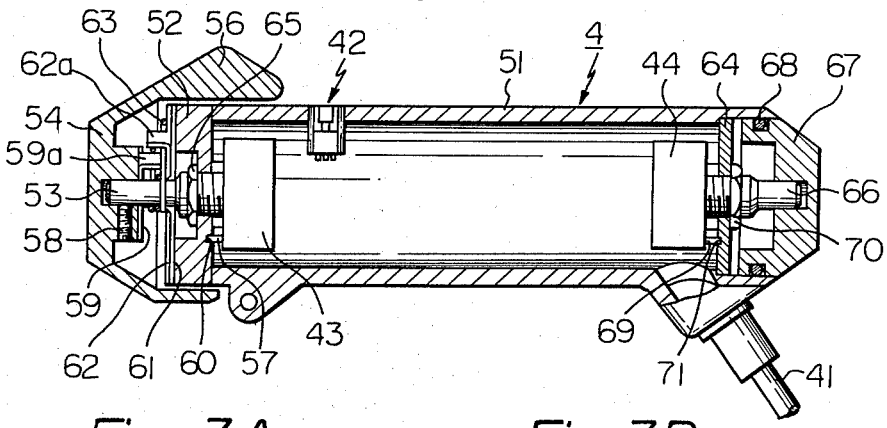
FIG. 2 is a side sectional view of one embodiment of the remote control unit in accordance with the present invention.
Figure 3A:
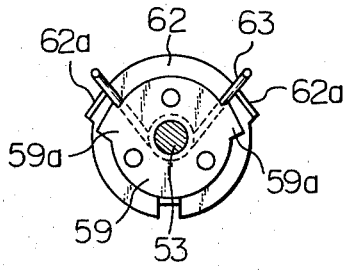
FIGS. 3A and 3B are end views, partly in section, of one embodiment of the elastic auto-resetting mechanism used in the remote control unit shown in FIG. 2.
Figure 3B:
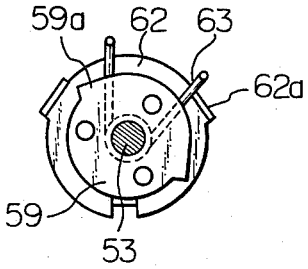

One embodiment of the remote control unit in accordance with the present invention is shown in FIGS. 2, 3A and 3B. The remote control unit 4 includes a cylindrical main casing 51 closed at one end by an end cap 52 through which a locally threaded shaft 53 extends in an axially rotatable arrangement. Outside the main casing 51, a main-dial 54 is secured to shaft 53 via a fastening screw 58 in a coaxial fashion. Inside the main casing 51, the shaft 53 carries the movable parts such as the slide-arm of the above-described main variable resistor 43 (see FIG. 1). The slide brush rotates with the arm shaft 53. A wing shaped knob 56 projects from main-dial 54 and extends over the periphery of the main casing 51. A pin 57 projects from the casing of the main variable resistor 43 and is received in a hole 60 formed in the inner face of the end cap 52. By operation of a fastening nut 65 screwed over the shaft 53 on the outer face of the end cap 52 the casing of, the main variable resistor 43 is pulled towards the end cap 52 and pin 57 is strongly pressed against the end cap 52 in order to interlock the casing of the main variable resistor 43 against turning with respect to the main casing 51.

As already described, provision of an elastic mechanism for effecting auto-resetting of the main-dial 54 to the zero-point is the gist of the present invention.

As shown in FIGS. 2 and 3A, a movable driver disc 59 is coaxially secured to the inner face of the main-dial 54 and has a pair of hooks **59*a* projecting towards the end cap 52 at symmetric positions on the periphery of the driver disc 59. In combination with this, a stationary stopper disc 62 is coaxially secured to the outer face of the end cap 52 via an intervening seal plate 61 and has a pair of hooks 62*a* projecting towards the main-dial 54 at symmetric positions on the periphery of the stopper disc 62. Both discs 59 and 62 are arranged so that, when the main-dial 54 is registered at the zero-point as shown in FIG. 3A, the hooks 62*a* of the stopper disc 62 are located on outer sides of the hooks 59*a* of the driver disc 59. The seal plate 61 and the stopper disc 62 are both provided with center apertures for allowing free turning of the shaft 53. An overriding spring 63 is provided at a position between the driver disc 59 and the stopper disc 62 with its center helical portion loosely winding around the shaft 53 and ends of its branches being in abutting engagement with the hooks 59*a* and 62*a* as shown in FIG. 3A**.

When the knob 56 is turned manually, the main-dial 54, the shaft 53, the drive disc 59 and the slide-arm of main variable resistor 43 turn about the axis of the shaft 53 in a common direction over a common turning angle.

Assuming that the knob 56, i.e. the shaft 53, is turned clockwisely from the angular position shown in FIG. 3A, the left side hook **59*a* of the driver disc 59 pushes the left side branch of the override spring 63 clockwise and the left side hook 59*a* is disengaged from the left side hook 62*a* of the stopper disc 62. The right side branch of the override spring 63 is interlocked against movement by engagement with the right side hook 62*a* of the stopper disc 62. Thus, the override spring 63 is forced to undergo elastic deformation. Concurrently with this process, turning of the shaft 53 causes corresponding turning of the slide arm of the main variable resistor 43 and the latter deviates from the zero-point in order to change its resistance. This change in the resistance of the main variable resistor 43 causes corresponding change in the electric signal, e.g. voltage signal, to be passed to the main control unit 2 from the remote control unit 4 and the rudder mechanism 3** is driven for operation, thereby the navigation course of the boat being accordingly changed.

As the force applied to the knob 56 is withdrawn, the tension in the above-described override spring 63 makes the left side branch return counterclockwise and, accordingly, push the left side hook **59*a* in a direction which causes driver disc 59 to turn counterclockwise about the axis of the shaft 53. This rotation of the driver disc 59 naturally accompanies similar and common turning of the main-dial 54, the knob 56, the shaft 53 and the slide brush of the main variable resistor 43. The returning movement of the left side branch of the override spring 63 is stopped upon abutment against the left side hook 62*a* of the stopper disc 62. Thus, the override spring 63 resumes the original nondeformed disposition with both branches resuming the initial angular positions. Accordingly, the main-dial 54, the knob 56 and the shaft 53 also resume the initial angular position and the main variable resistor 43** is again registered at the zero-point.

It will be well understood that substantially similar process is traced by the above-described mechanical parts when the knob 56, i.e. the shaft 53, is turned counterclockwisely from the angular position shown in FIG. 3A.

The end of the main casing 51 opposite to the main variable resistor mounting is closed by an end cap 64 which has a center aperture for allowing idle passage of a locally threaded shaft 66 for the subordinate variable resistor 44. A pin 69 projects from the casing of variable resistor 44 and is received in a hole 71 formed in the inner face of the end cap 64. By operation of a fastening nut 70 screwed over the shaft 66 on the outer face of the end cap 64, variable resistor 44 is pulled towards the end cap 64 and pin 69 is strongly pressed against the end cap 64 in order to interlock the casing of the subordinate variable resistor 44 against turning with respect to the main casing 51. Outside the end cap 64, the shaft 66 coaxially and securedly carries the sub-dial 67 which is partly inserted into the main casing via an O-ring 68.

By turning sub-dial 67, the slide brush of subordinate variable resistor 44 is displaced via the shaft 66 so that the resistance of variable resistor 44 is adjusted as desired. This contributes to the hereinbefore explained compensation of the main variable resistor 43.

The A-M switch 42 is provided on the periphery of the main casing 51. Although a push button type switch is used for this purpose in the illustrated embodiment, different types of switches such as a snap type switch is employable also. The A-M switch 42 is advantageously provided with an water-tight construction.

In accordance with the present invention, the remote control unit is of a very light construction and easily operable by simple finger action without requiring any highly skilled technique for effecting zero-point resetting. Since the main-dial is always urged by the elastic mechanism into keeping the zero-point, accidental shock applied to the remote control does never accompany unexpected turning of the main-dial which, under some situations, may cause serious accidents. Especially when the present invention is applied to the automatic steering system of a boat or the like, it assures high safety in navigation and optimum navigation mode under variable environmental conditions. In addition, it frees the busy operator on the boat or crusers from the troublesome zero-point resetting work which otherwise requires highly skilled technique.

I claim:

1. An improved remote control unit, comprising:

(A) an elongated, generally cylindrical, main casing housing an A-M switch, a main variable resistor and a subordinate variable resistor;

(B) a main-dial rotatably coupled to one longitudinal end of said main casing and operationally coupled to said main variable resistor, said main-dial being rotatable about the longitudinal axis of said main casing over a prescribed angle on both sides of a zero-point responsive to an external force applied thereto;

(C) means for elastically and automatically restoring said main-dial to said zero-point when said external force is removed from said main-dial;

(D) a sub-dial rotatably coupled to the other longitudinal end of said main casing and operationally coupled to said subordinate variable resistor, said sub-dial being rotatable about said longitudinal axis of said main casing over a prescribed angle on both sides of a zero-point responsive to an external force applied thereto;

(E) said main-dial being operationally coupled to said main variable resistor via a shaft which is rotatably coupled to said main casing coaxially therewith and which extends through said one end of said main casing; and (F) said elastically and automatically restoring means including:

(1) a driver disc coaxially secured to said shaft outside said one end of said main casing and provided with a pair of hooks projecting towards said main casing at symmetric positions on the periphery thereof;

(2) a stopper disc coaxially secured to said one end of said main disc while allowing free turning of said shaft and provided with a pair of hooks projecting towards said driver disc at symmetric positions on the periphery thereof; and (3) an override spring interposed between said two discs and having a center helical portion loosely winding around said shaft and a pair of branches whose ends are in abutting engagement with said hooks of said two discs in such an arrangement that turning of said shaft causes elastic deformation of said override spring via said driver disc.

* * * * *